United States Patent [19]

Taguchi

[11] Patent Number: 4,909,766

[45] Date of Patent: Mar. 20, 1990

[54] TILT DEVICE FOR MARINE PROPULSION UNIT

[75] Inventor: Michihiro Taguchi, Hamamatsu, Japan

[73] Assignee: Sanshin Kogyo Kabushiki Kaisha, Hamamatsu, Japan

[21] Appl. No.: 222,191

[22] Filed: Jul. 21, 1988

[30] Foreign Application Priority Data

Jul. 21, 1987 [JP] Japan ..... 62-179921

[51] Int. Cl.[4] ..... B63H 21/26; B63H 5/12

[52] U.S. Cl. ..... 440/61

[58] Field of Search ..... 440/61, 56; 91/445

[56] References Cited

U.S. PATENT DOCUMENTS 3,722,455 3/1973 Carpenter ..... 440/61

3,788,401 1/1974 Scheidt et al. ..... 91/445 X

FOREIGN PATENT DOCUMENTS 171791 9/1984 Japan ..... 440/61

60-234096 11/1985 Japan .

*Primary Examiner*—Sherman D. Basinger

*Attorney, Agent, or Firm*—Ernest A. Beutler

[57] ABSTRACT

A hydraulic tilt and trim arrangement for an outboard drive that includes a trim fluid motor and a tilt fluid motor operated by a common fluid pump. A selector valve is provided in the circuit connecting the pump with the fluid motors for disabling the communicaion to the trim fluid motor to achieve rapid tilting up. When the selector valve is in this position, a relief valve is provided that permits relief of the fluid pressure in the trim fluid motor when loads are applied to the trim fluid motor.

7 Claims, 2 Drawing Sheets

TILT DEVICE FOR MARINE PROPULSION UNIT

BACKGROUND OF THE INVENTION

This invention relates to a tilt device for a marine propulsion unit and more particularly to an improved tilt and trim arrangement for marine propulsion units.

As is well known, many forms of marine propulsion units such as the outdrive of an inboard/outboard drive or an outboard motor are mounted for movement relative to the associated watercraft between a plurality of trim adjusted positions wherein the angular disposition of the propulsion unit relative to the watercraft can be changed to provide optimum performance. In addition, it is a normal practice to support the outboard drive so that it can be tilted up to an out of the water condition.

In the larger units, it is frequently the practice to incorporate some form of power device for achieving both the tilt and the trim operation of the outboard drive. Most normally, the power device is comprised of a pair or series of fluid motors that operate on the outboard drive to achieve both tilt and trim operation. In the most normal type of application, a relatively large diameter, short stroke trim fluid motor is incorporated for achieving the trim operation while a smaller diameter, larger stroke fluid motor is employed for achieving the tilt operation. Conventionally, these fluid motors are supplied with fluid under pressure from a common fluid pump through a hydraulic circuit arrangement. In connection with conventional systems, the tilt up operation must be preceded by full trim movement of the trim fluid motor before the tilt fluid motor receives the full pressure from the pump to achieve tilt up operation. This results in relatively slow tilting up operation.

It has been proposed, however, to employ an arrangement wherein the fluid circuitry for the tilt and trim motors includes a selector valve that bypasses the fluid directly to the tilt fluid motor without flowing to the trim fluid motor to achieve rapid tilt up operation. Such selector valves have the function of, in essence, isolating the trim fluid motor from the hydraulic circuit in order to achieve a faster operation. However, this means that the trim fluid motor is hydraulically isolated from the circuitry of the system.

The hydraulic isolation of the trim fluid motor gives rise to certain difficulties. For example, if the selector valve is left in a position wherein the trim motor is isolated, impacts or driving thrusts transmitted from the outboard drive to the trim motor can cause high pressures to be exerted on the trim motor and its seals. These high pressure applications can cause damage to the motor or its seal.

It is, therefore, a principal object of this invention to provide an improved hydraulic tilt and trim arrangement wherein rapid tilt up operation can be achieved through the use of a selector valve but the trim fluid motor is protected from hydraulic impacts by a pressure relief system.

It is a further object of this invention to provide an improved hydraulic tilt and trim arrangement incorporating a selector valve for isolating the trim cylinder under certain circumstances and which also protects the trim cylinder from impacts when it is isolated.

SUMMARY OF THE INVENTION

This invention is adapted to be embodied in a hydraulic tilt and trim arrangement for an outboard drive that is comprised of a trim fluid motor associated with the outboard drive for moving the outboard drive between a plurality of trim adjusted positions. A tilt fluid motor is associated with the outboard drive for moving the outboard drive beyond the uppermost of the trim adjusted positions to a tilted up, out of the water position. A fluid pump supplies pressurized fluid for the arrangement through a supply circuit that connects the pump to the tilt and trim fluid motors for pressurizing those fluid motors to adjust the position of the outboard drive. The supply circuit includes selector valve means moveable to a first position for disabling the communication of the fluid pump to the trim fluid motor for supplying full output to the tilt fluid motor for effecting rapid tilt up of the outboard drive. In accordance with the invention, relief valve means permit flow from the trim fluid motor when the selector valve is in its first position to protect the trim fluid motor under impact conditions.

DETAILED DESCRIPTION OF THE PREFERRED EMBODIMENT OF THE INVENTION

Figure 2:
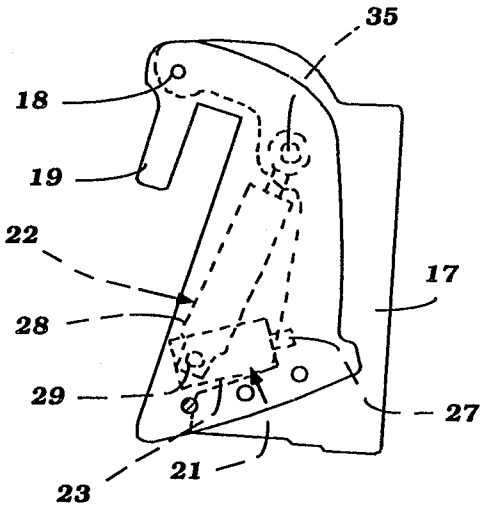
FIG. 2 is a partial, enlarged, side elevational view showing the tilt and trim mechanism and its association with the outboard motor.
Figure 1:
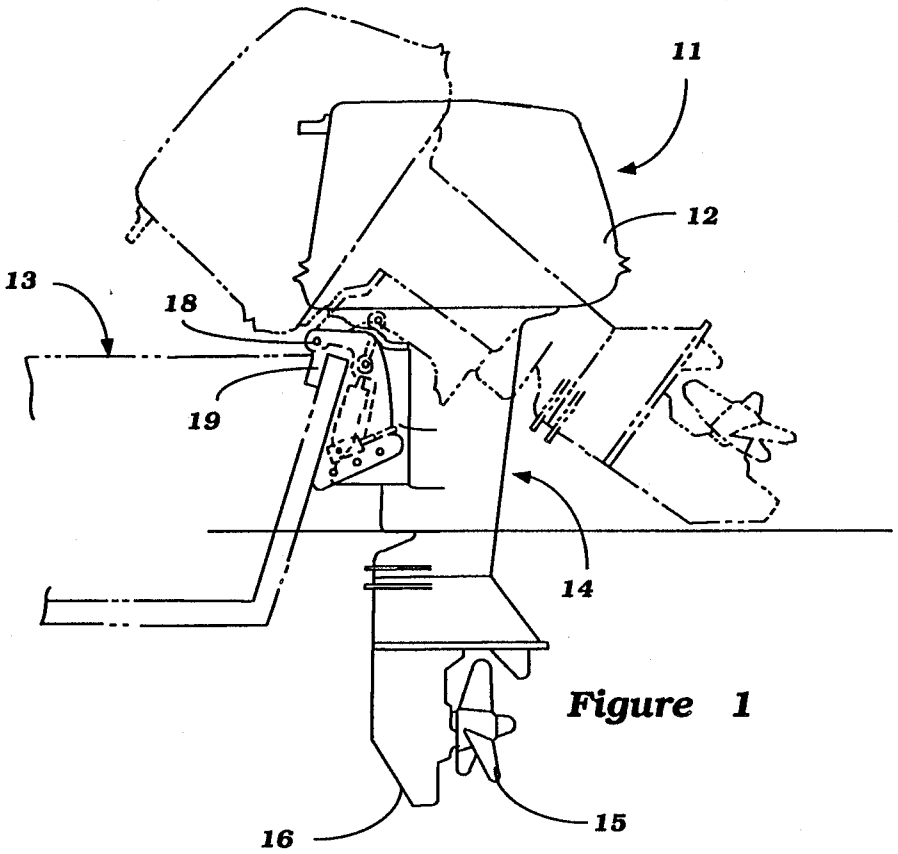
FIG. 1 is a side elevational view of an outboard motor constructed in accordance with an embodiment of the invention as attached to the transom of an associated watercraft. The outboard motor is shown in normal running condition in the solid line views and in a tilted up, out of the water condition in the phantom line view.

Referring first to FIGS. 1 and 2, an outboard motor constructed in accordance with an embodiment of the invention is identified generally by the reference numeral 11 and is shown attached to the transom of a watercraft, shown partially in phantom at 13. The invention is described in conjunction with an outboard motor but it is to be understood that it may be applied equally as well with the outboard drive portion of an inboard/outboard drive or a wide variety of other forms of propulsion devices, generally termed "outboard drives".

The outboard motor 11 includes a powerhead 12 that contains a driving internal combustion engine and a surrounding protective cowling. The engine drives a driveshaft (not shown) that is journaled within a driveshaft housing 14 that depends from the powerhead 12 and which drives a propeller 15 of a lower unit 16 in a known manner, which may include a forward, neutral, reverse transmission of a known type that is contained within the lower unit 16.

The driveshaft housing 14 has affixed to it a steering shaft (not shown) which is, in turn, journaled for steering movement about a generally vertically extending steering axis in a swivel bracket 17. The swivel bracket 17 is pivotally connected by means of a horizontally extended pivot pin 18 to a clamping bracket 19. The clamping bracket 19 is, in turn, affixed to the transom 12 in any known manner. Pivotal movement of the swivel bracket 17 about the clamping bracket 19 achieves trim and tilt adjustment of the outboard motor 11, as is well known in this art. The trim adjustment takes place through a relatively narrow range so as to adjust the trim position of the propeller 15 relative to the hull 13 so as to achieve optimum performance. The tilt movement permits the outboard motor 11 to be moved from a running condition as shown in solid line view beyond the uppermost trim adjusted position to an out of the water position as shown in phantom in FIG. 1.

A power arrangement is incorporated for effecting the trim and tilt adjustment of the outboard motor 11 and this power arrangement includes a pair of trim cylinder assemblies, each of which is identified generally by the reference numeral 21 and a tilt cylinder assembly, indicated generally by the reference numeral 22 and shown in most detail in FIG. 2. The trim cylinder assemblies 21, which may also be considered as trim fluid motors, are comprised of cylinder housings 23 that are fixed in a suitable manner to the clamping bracket 19. As may be seen schematically in FIG. 3, the cylinder assemblies 23 each slidably support pistons 24 which divide the interior of the cylinders 23 into a lower chamber 25 and an upper chamber 26. A piston rod 27 is affixed to the piston 24 and extends through the upper chamber 26 and engages the swivel bracket 17 for effecting pivotal movement of the swivel bracket 17 relative to the clamping bracket 19 when the piston 24 reciprocates in the cylinder 23.

Figure 3:
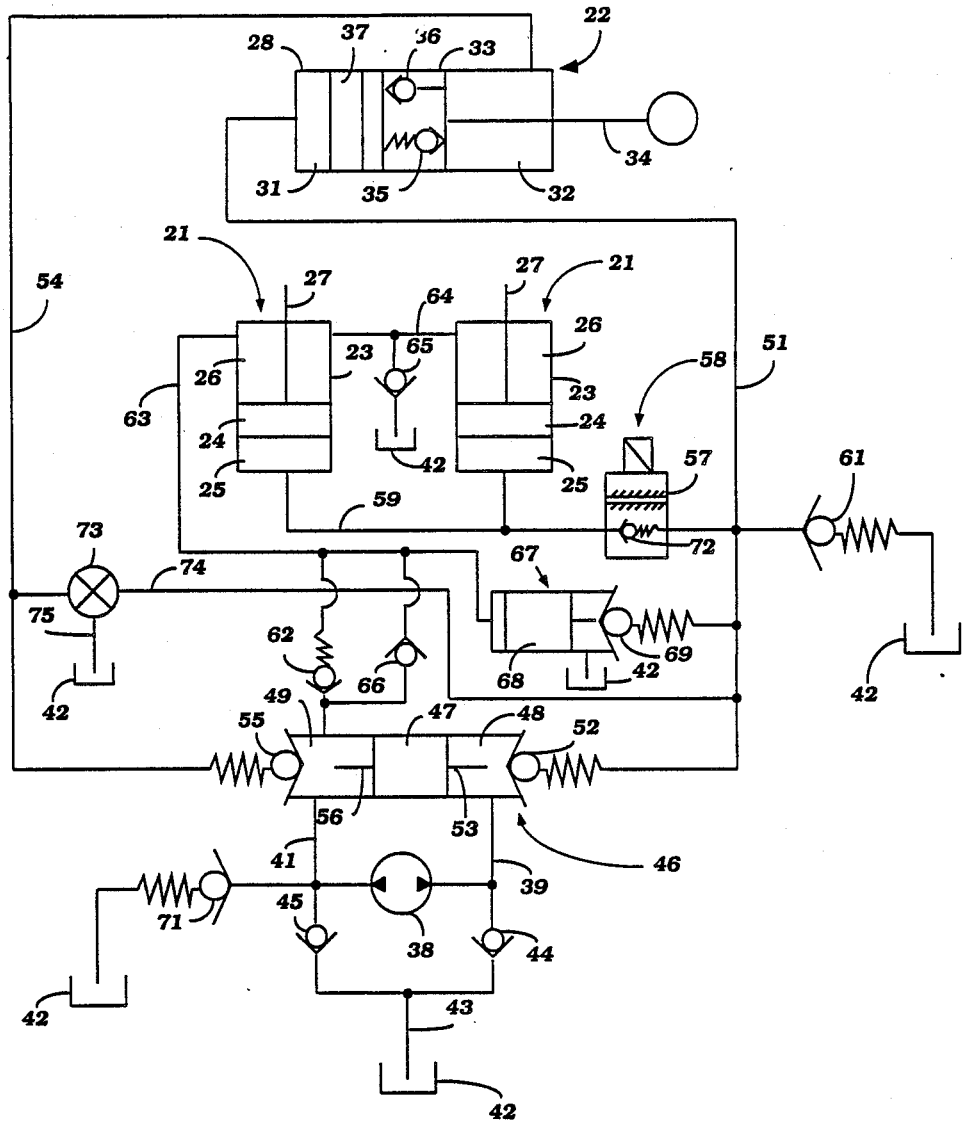
FIG. 3 is a schematic view showing the hydraulic circuitry for the tilt and trim arrangement.

The tilt cylinder or fluid motor 22 is comprised of a cylinder 28 that is provided with a trunion portion that is pivotally connected to the clamping bracket 19 by means of a pivot pin 29. The cylinder 28, like the cylinders of the trim motors 21, is divided into a lower chamber 31 and an upper chamber 32 by means of a piston 33 that is slidably supported within the cylinder 28 (FIG. 3). The piston 33 has connected to it a piston rod 34 which extends through the upper chamber 32 and which is pivotally connected to the clamping bracket 17 by means of a pivot pin 35. As a result, movement of the piston 33 within the cylinder 28 will effect pivotal movement of the swivel bracket 17 relative to the clamping bracket 19.

The tilt cylinder 22 is further provided with a damping arrangement for permitting the outboard motor 11 to pop up when an underwater obstacle is struck and then to return after the obstacle is cleared. For this purpose, there is provided an absorber valve 35 in a passageway extending through the piston 33 from the chamber 32 to the chamber 31. When the outboard motor 11 strikes an underwater obstacle with sufficient impact so as to overcome the bias of the absorber valve 35, the valve 35 will open and permit flow through the piston 33 so that the outboard motor 11 may pop up. When the underwater obstacle is cleared, a relief valve 36 will open and permit flow from the chamber 31 back to the chamber 32 under the weight of the outboard motor 11.

A floating piston 37 is contained within the chamber 31 so as to insure that the outboard motor 11 will return to its previously trim adjusted position once the underwater obstacle has been cleared. It should be noted that the trim cylinders 21 will also be held in position and they will insure that the motor 11 returns to its previously trim adjusted position.

Continuing to refer to FIG. 3, the hydraulic system for operating the trim cylinders 21 and tilt cylinder 22 will now be described in detail. This system includes a reversible fluid pump 38 that is driven by a reversible electric motor so as to selectively pressurize either a tilt or trim up line 39 or a tilt and trim down line 41. The lines 39 and 41 also communicate with a reservoir 42 through a supply conduit 43 and respective check valves 44 and 45. When the pump 38 is driven to pressurize the line 39, the line 41 will act as a return and supply line and vice versa.

The hydraulic circuitry for supplying fluid to the trim cylinders 21 and tilt cylinder 22 includes a shuttle valve assembly, indicated generally by the reference numeral 46. The shuttle valve assembly 46 includes a shuttle piston 47 that divides the shuttle valve interior into chambers 48 and 49. The up line 39 enters the chamber 48 while the down line 41 enters the chamber 49. In addition, the chamber 48 communicates with a tilt up supply line 51 by means of a check valve 52. The check valve 52 is adapted to be opened when the chamber 48 is pressurized. In addition, when the chamber 49 is pressurized, the shuttle piston 47 will move to the right and a projection 53 of the piston 47 will engage and unseat the check valve 52.

In a similar manner, the chamber 49 communicates with a tilt down supply line 54 through a check valve 55. The check valve 55 opens when the chamber 49 is pressurized sufficiently to supply fluid to the chamber 32 of the trim cylinder 22. In addition, the shuttle piston 47 has an extension 56 that is adapted to engage and unseat the ball check valve 55 when the chamber 48 is pressurized.

The tilt up supply line 51 normally communicates with the chambers 25 of the trim cylinders 21 through an unrestricted passage 57 of a selector valve 58. The passage 57 of the selector valve 58 communicates the trim up supply line 51 with a conduit 59 that supplies fluid to the chambers 25 of the trim pistons 21. The selector valve 58 can be operated in any known manner such as either electrically by a solenoid or manually.

There is further provided a trim up relief valve 61 in communication with supply line 51 for opening and bypassing fluid pressurized by the pump 38 back to the reservoir 42 in the event of an overload or when the cylinder 22 reaches the end of its stroke.

For trim down adjustment, the chamber 49 of the shuttle valve 46 communicates with a pressure responsive valve 62 that opens at a predetermined pressure so as to communicate the chamber 49 with a conduit 63 that extends to one of the chambers 26 of one of the trim cylinders 21. This chamber 26 communicates with the corresponding chamber 26 of the other trim cylinder 21 through an interconnecting passageway 64. A make up line including a check valve 65 also communicates the line 64 with the reservoir 42.

The chambers 26 and line 63 also communicates back with the chamber 49 through a check valve 66 which opens at a substantially lower pressure than the pressure responsive valve 62 and permits flow in the opposite direction.

When the line 63 is pressurized, a shuttle valve 67 having a shuttle piston 68 functions to open a check valve 69 that communicates the line 51 with the reservoir 42.

There is also provided a trim down relief valve 71 that communicates the trim down line 41 with the reservoir 42 for preventing overpressurization when the piston 33 and pistons 24 reach the ends of their strokes.

With conventional tilt and trim systems employing selector valves 58, the selector valve 58 is moved to a closed position, as shown in FIG. 3, so that pressurization of the line 51 will cause fluid to flow only to the tilt cylinder 22 for effecting rapid tilt up. As has been previously noted, however, when the selector valve 58 is in its closed position, there will be a hydraulic lock created in the chambers 25. Under high driving thrusts or under reverse impact, this high pressure can cause damage to the trim cylinders 21. To avoid this, there is provided a further passageway 72 in the selector valve 58 in which a pressure responsive check valve is positioned. The check valve 72 will open to relieve this high pressure under impact, as will become apparent.

OPERATION

The operation of the system will now be described. If it is desired to achieve rapid tilt up of the outboard motor 11, regardless of the trim position of the outboard motor, the selector valve 58 is operated so as to move it to the position shown in FIG. 3. The motor and fluid pump 38 is then driven so as to pressurize the line 39 and cause the line 41 to act as a return line. Pressurization of the line 39 causes the chamber 48 of the shuttle valve 46 to be pressurized and opens the check valve 52 to pressurize the line 51. When the line 51 is pressurized, fluid will be supplied under pressure to the cylinder chamber 31 below the floating piston 37 and the outboard motor 11 will be tilted up rapidly. It should be noted that the pistons 24 of the trim cylinders 21 have a generally larger diameter than the piston 33 of the tilt cylinder 32 so that if pressure were supplied to the trim cylinders during this operation, the movement would be much slower. Thus, closure of the selector valve 58 permits rapid tilt up operation.

When the shuffle valve chamber 48 is pressurized, the shuttle piston 47 will move to the left to unseat the check valve 55. Then fluid may flow from the tilt cylinder chamber 32 back to the line 41 through the line 54 and opened check valve 55. During this operation, the trim cylinder pistons 24 will be retained in their position. Therefore, when the outboard motor is again lowered, it will return to the previous trim adjusted position.

If it is desired to obtain rapid tilt down operation, the selector valve 58 is left in the position shown in FIG. 3 and the fluid pump 38 is operated so as to pressurize the line 41 wherein the line 39 acts as a return line. When the line 41 is pressurized, the pressure in the shuttle valve chamber 49 will be sufficient to open the ckeck valve 55 and permit the line 54 to be pressurized. It should be noted that the pressure responsive valve 62 opens at a substantially higher pressure than the check valve 55 and hence the valve 62 will not open under this circumstance. Therefore, fluid will be supplied totally to the chamber 32 of the tilt cylinder assembly 22 and the piston 33 and floating piston 37 will be driven rapidly downwardly to effect tilt down of the outboard motor 11.

When the chamber 49 of the shuttle valve 46 is pressurized, the shuttle piston 47 will move to the right and the piston projection 53 will unseat and open the check valve 52. Fluid can then be expelled from the chamber 31 through the line 51 and shuttle valve 46 back to the line 39 which acts as a return line under this condition.

Since the selector valve 58 is in the closed position, the trim cylinder assemblies 21 will be held in position until the outboard motor 11 tilts down sufficiently for the swivel bracket 17 to contact the piston rods 27. At this time, there will be a rapid pressure rise in the chambers 25 and if the pump 38 is continued to operate, the relief valve 72 will open and permit the trim pistons 24 to be moved downwardly. Were it not for the operation of the relief valve 72, this high pressurization in the trim cylinders 21 could damage them.

In order to achieve normal trim up operation, the selector valve 58 is moved to the position wherein its passageway 57 communicates the line 51 with the line 59. When this occurs, fluid will be supplied to the trim cylinder chambers 25 as well as the tilt cylinder chamber 28 and trim adjustment can be effected. As has been previously noted, the relief valve 61 will provide pressure relief during this operation, if required.

In order to achieve trim up operation, the fluid pump 38 is driven to pressurize the line 39 and the check valve 52 will be opened when the shuttle valve chamber 48 is pressurized so as to deliver fluid to the tilt piston chamber 31. Since the line 51 now communicates with the line 59 through the passage 57 of the selector valve 58, the trim cylinder chambers 25 will also be pressurized and the outboard motor 11 can be trimmed up until the desired position is reached.

During the trim up operation, fluid is expelled from the tilt piston chamber 32 through the check valve 55, which is opened by the shuttle valve piston projection 56, as aforenoted, to the line 41. At the same time, fluid may be expelled from the trim cylinder chambers 26 through the line 63 to open the check valve 66 and return to the line 41 through the shuttle valve chamber 49.

Trim down operation is achieved by running the fluid pump 39 in a direction to pressurize the line 41 and cause the line 39 to act as a return line. Pressurization of the line 41 pressurizes the shuttle valve chamber 49 and effects opening of the check valve 55 so that the tilt cylinder chamber 32 will be pressurized. However, the force required to tilt the outboard motor down will be sufficient that the pressure in the chamber 49 will be sufficient to unseat the pressure responsive valve 62 and the trim cylinder chamber 26 will be pressurized so as to move the trim pistons 42 downwardly. Since the selector valve 58 is in a position where the line 57 is open, the fluid from the trim cylinder chambers 25 can be discharged back to the line 39 through the line 51 and opened check valve 52 of the shuttle valve 46.

In the event the outboard motor is operated in a trim adjusted position and the selector valve is left in the position shown in FIG. 3 and a high driving thrust or impact on reverse operation is delivered from the swivel bracket 17 to the trim cylinder piston rods 27, high pressures in the chambers 25 can be relieved through opening of the pressure responsive valve 72 so that no damage will occur.

The system also incorporates a manually operable valve 73 that is positioned in a line 74 that interconnects the lines 51 and 54. Opening of the valve 73 permits manual adjustment of the position of the outboard motor and, if desired, manual tilting up or tilting down. Any make up fluid required for this operation can be drawn from the reservoir 42 through the line 75.

It should be readily apparent from the foregoing description that a highly effective tilt and trim construction has been disclosed which permits rapid tilting up without operation of the trim cylinders but which also protects the trim cylinders from damage under high impact conditions.

It is to be understood that the foregoing description is that of a preferred embodiment of the invention and that various changes and modifications may be made without departing from the spirit and scope of the invention, as defined by the appended claims.

I claim:

1. In a hydraulic tilt and trim arrangement for an outboard drive comprising a trim fluid motor associated with said outboard drive for moving said outboard drive between a plurality of trim adjusted positions, a tilt fluid motor associated with said outboard drive for moving said outboard drive beyond the uppermost of said trim adjusted positions to a tiled up, out of the water position, a fluid pump for supplying pressurized fluid for said arrangement, and a supply circuit connecting said fluid pump to said trim and tilt fluid motors for pressurizing said fluid motors to adjust the position of said outboard drive, said supply circuit including selector valve means moveable to a first position for disabling the communication of said fluid pump to a chamber of said fluid motor for supplying full output to said tilt fluid motor for effecting rapid tilt up of said outboard drive, the improvement comprising relief valve means for permitting flow from said chamber of said trim fluid motor when said selector valve is in said first position.

2. In a hydraulic tilt and trim arrangement for an outboard drive as set forth in claim 1 wherein the supply circuit provides a common source of fluid from said fluid pump to said tilt and trim fluid motors and wherein the selector valve is moveable to a second position wherein said fluid pump communicates with said chamber of said trim fluid motor.

3. In a hydraulic tilt and trim arrangement for an outboard drive as set forth in claim 2 wherein the relief valve means is operative only when the selector valve means is in its first position.

4. In a hydraulic tilt and trim arrangement for an outboard drive as set forth in claim 3 wherein the relief valve means is formed in the selector valve means.

5. In a hydraulic tilt and trim arrangement for an outboard drive as set forth in claim 1 wherein the selector valve means is moveable between the first position and a second position wherein the supply circuit communicates the fluid pump with the chamber of the trim fluid motor.

6. In a hydraulic tilt and trim arrangement for an outboard drive as set forth in claim 5 wherein the relief valve means is operative only when the selector valve means is in its first position.

7. In a hydraulic tilt and trim arrangement for an outboard drive as set forth in claim 6 wherein the relief valve means is formed in the selector valve means.

* * * * *